US010450829B2

(12) United States Patent
Melenyzer et al.

(10) Patent No.: US 10,450,829 B2
(45) Date of Patent: Oct. 22, 2019

(54) DRILLABLE PLUG

(71) Applicant: SCHLUMBERGER TECHNOLOGY CORPORATION, Sugar Land, TX (US)

(72) Inventors: George J. Melenyzer, Cypress, TX (US); Christopher Cromer, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 251 days.

(21) Appl. No.: 14/333,712

(22) Filed: Jul. 17, 2014

(65) Prior Publication Data

US 2015/0021042 A1 Jan. 22, 2015

Related U.S. Application Data

(60) Provisional application No. 61/856,312, filed on Jul. 19, 2013.

(51) Int. Cl.
*E21B 33/12* (2006.01)
*E21B 33/134* (2006.01)

(52) U.S. Cl.
CPC ..... *E21B 33/134* (2013.01); *E21B 33/1204* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,693,343 | A * | 11/1954 | Darin | E21B 7/003 175/171 |
| 4,422,794 | A * | 12/1983 | Deken | E21B 17/046 292/128 |
| 4,432,418 | A * | 2/1984 | Mayland | E21B 23/06 166/123 |
| 6,167,963 | B1 | 1/2001 | McMahan et al. | |
| 2003/0226660 | A1 | 12/2003 | Winslow et al. | |
| 2008/0190600 | A1 * | 8/2008 | Shkurti | E21B 33/1216 166/134 |
| 2008/0308266 | A1 | 12/2008 | Roberts et al. | |

(Continued)

FOREIGN PATENT DOCUMENTS

| | | | | |
|---|---|---|---|---|
| WO | WO 0202906 | A2 * | 1/2002 | E21B 33/1204 |
| WO | 0202906 | A3 | 4/2002 | |

OTHER PUBLICATIONS

International Search Report and Written Opinion issued in related PCT application PCT/US2014/047132 dated Nov. 21, 2014, 10 pages.

*Primary Examiner* — Taras P Bemko
*Assistant Examiner* — Ronald R Runyan

(57) ABSTRACT

A drillable plug includes a mandrel having an upper end and a lower axial section, the lower axial section having a geometry transition point separating an upper circular mandrel profile from a lower non-circular mandrel profile, a seal element disposed around the upper circular mandrel profile, and a lower cone having an inner surface forming a passage, the lower cone disposed around the lower non-circular mandrel profile whereby the lower cone is rotationally locked with the mandrel and a lower slip assembly moveably disposed on a sloped outer surface of the lower cone.

20 Claims, 6 Drawing Sheets

(56) References Cited

U.S. PATENT DOCUMENTS

| | | | | |
|---|---|---|---|---|
| 2010/0326650 | A1 | 12/2010 | Tran et al. | |
| 2011/0259610 | A1* | 10/2011 | Shkurti ..... | E21B 33/1204 166/386 |
| 2013/0048272 | A1 | 2/2013 | Vanlue et al. | |

* cited by examiner

DRILLABLE PLUG

CROSS-REFERENCE TO RELATED APPLICATIONS

The present application claims, under 35 U.S.C. § 119, benefits of U.S. Provisional Application Ser. No. 61/856,312, filed on Jul. 19, 2013, which is incorporated by reference herein in its entirety.

BACKGROUND

This section provides background information to facilitate a better understanding of the various aspects of the disclosure. It should be understood that the statements in this section of this document are to be read in this light, and not as admissions of prior art.

In drilling, completing, or reworking wells, it often becomes necessary to isolate particular zones within the well. In some applications, downhole tools, known as temporary or permanent bridge plugs, are inserted into the well to isolate zones. The purpose of the bridge plug is to isolate some portion of the well from another portion of the well. In some instances, perforations in the well in one section need to be isolated from perforations in another section of the well. In other situations, there may be a need to use a bridge plug to isolate the bottom of the well from the wellhead.

SUMMARY

In accordance to aspects of the disclosure a drillable plug includes a mandrel having a top end and a lower axial section, the lower axial section having a geometry transition point separating an upper circular mandrel profile from a lower non-circular mandrel profile, a seal element disposed around the upper circular mandrel profile, and a lower cone having an inner surface forming a passage, the lower cone disposed around the lower non-circular mandrel profile whereby the lower cone is rotationally locked with the mandrel and a lower slip assembly moveably disposed on a sloped outer surface of the lower cone. A method includes milling or drilling through a drillable plug that is set in a wellbore. The method may include milling or drilling the outer components of the plug that are disposed about the mandrel.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

Embodiments of drillable plugs and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
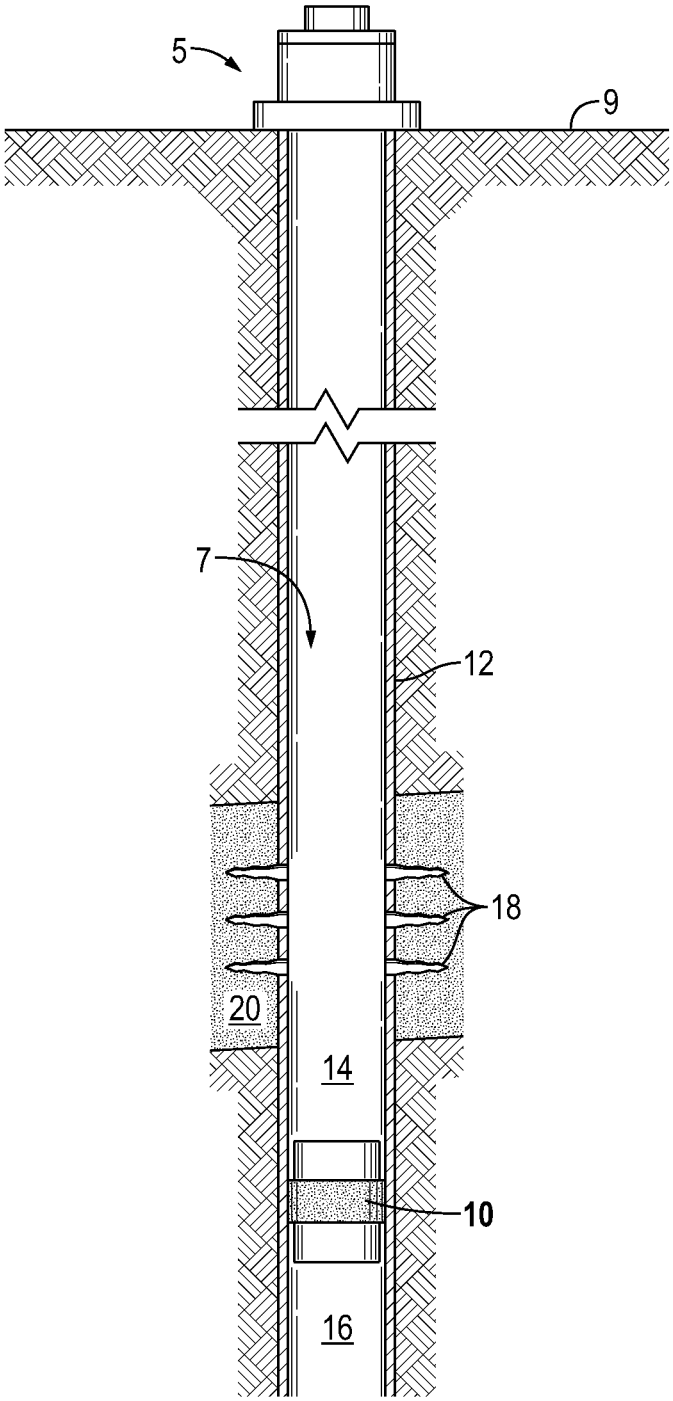
FIG. 1 illustrates a well system in which a drillable plug assembly is set in a wellbore in accordance to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

In accordance with aspects of the disclosure, a drillable plug 10 includes a mandrel 22, a sealing element 34 disposed around the mandrel, an upper slip assembly 42 and a lower slip assembly 44 disposed around the mandrel, and an upper cone 38 and a lower cone 40 disposed around the mandrel adjacent the upper and lower slip assemblies, respectively. The drillable plug may be deployed and/or set for example by wireline, coil tubing, or a conventional drill string. The plug may be placed in engagement with the lower end of a setting tool that includes a latch down mechanism and a ram. The plug is then lowered through the casing to the desired depth and oriented to the desired orientation. When setting the plug, a setting tool pulls upwardly on the mandrel, thereby pushing the upper and lower cones along the mandrel. This forces the upper and lower slip assemblies, backup rings, and the sealing element radially outward, thereby engaging the slip assemblies with the inside wall of the casing, see for example FIG. 4.

When it is desired to remove one or more of these plugs from a wellbore, it is often simpler and less expensive to mill or drill them out rather than to implement a complex retrieving operation. In milling, a milling cutter is used to grind the tool, or at least the outer components thereof, out of the wellbore. In drilling, a drill bit or mill is used to cut and grind up the components of the plug to remove it from the wellbore. It has been found that when milling or drilling up a plug, the lower outer components of the plug may no longer engage the mandrel. Thus, as the milling or drilling tool rotates to mill or drill up the plug, the lower components spin or rotate within the well. This spinning or rotation of the lower components during drilling of the plug increases the time required to drill up the plug.

FIG. 1 schematically illustrates a well 5 with drillable plug 10 disposed in a wellbore 7. Drillable plug 10 may be attached to a setting tool and run into the hole on a conveyance such as wireline or tubing and then actuated with, for example, a hydraulic system. In FIG. 1, drillable plug 10 is set in casing 12 isolating an upper zone 14 of the wellbore from a second or lower zone 16 of the wellbore relative to the surface 9. Perforations 18 are illustrated formed through casing 12 and providing fluid communication with the surrounding formation 20. Drillable plug 10, e.g. bridge plug or frac plug (i.e., fracturing plug), may be utilized for various wellbore operations, or applications, as will be understood by those skilled in the art with benefit of this disclosure.

Figure 2:
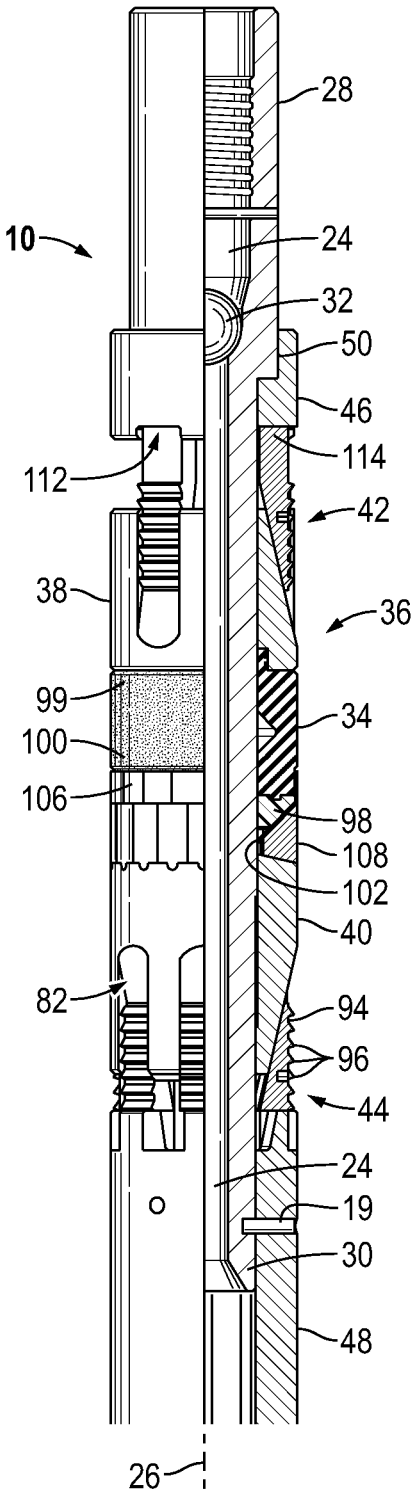
FIGS. 2 and 3 are sectional illustrations of a drillable plug assembly in an unexpanded position in accordance to one or more aspects of the disclosure.
Figure 3:
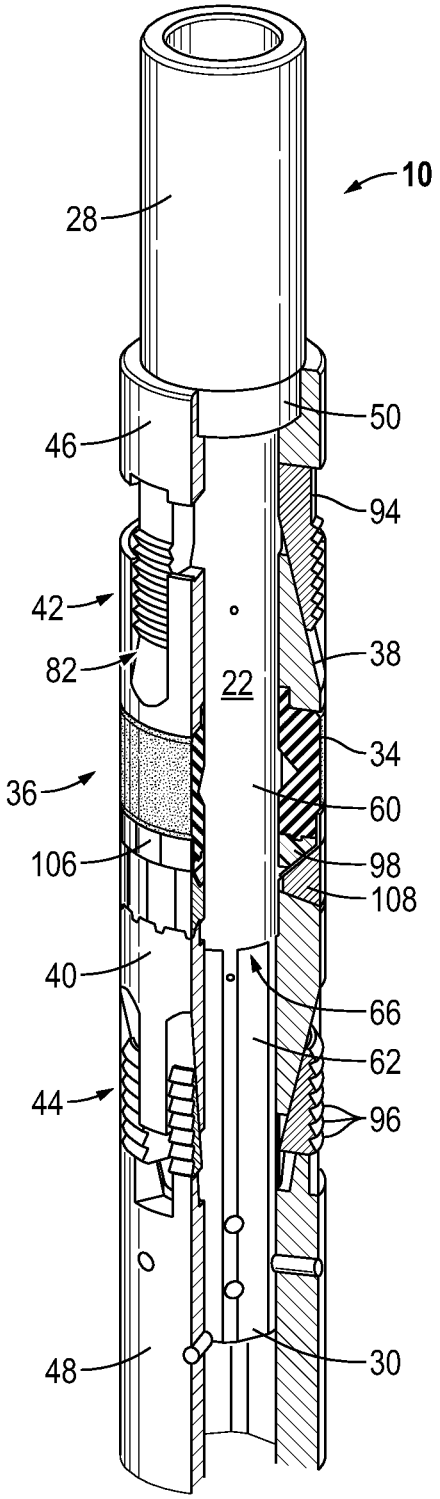
Figure 4:
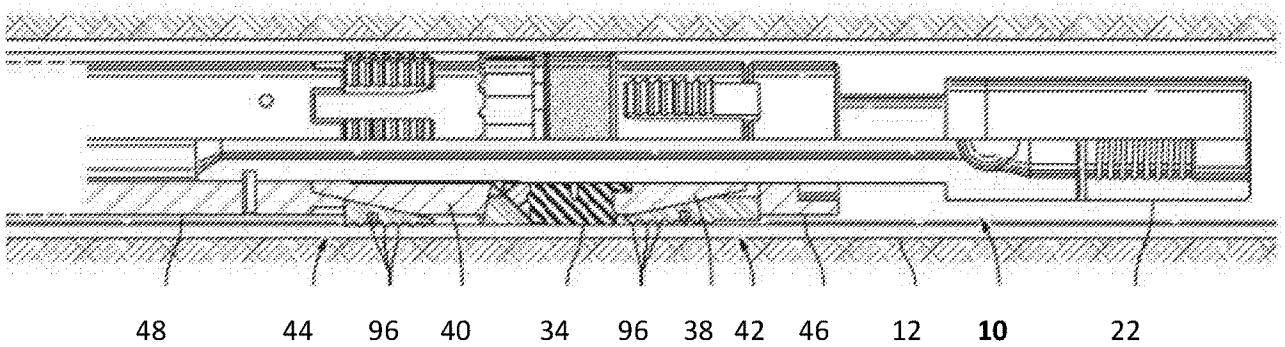
FIGS. 4 and 5 illustrate a drillable plug assembly in an expanded position sealing against a casing in accordance to one or more aspects of the disclosure.
Figure 5:
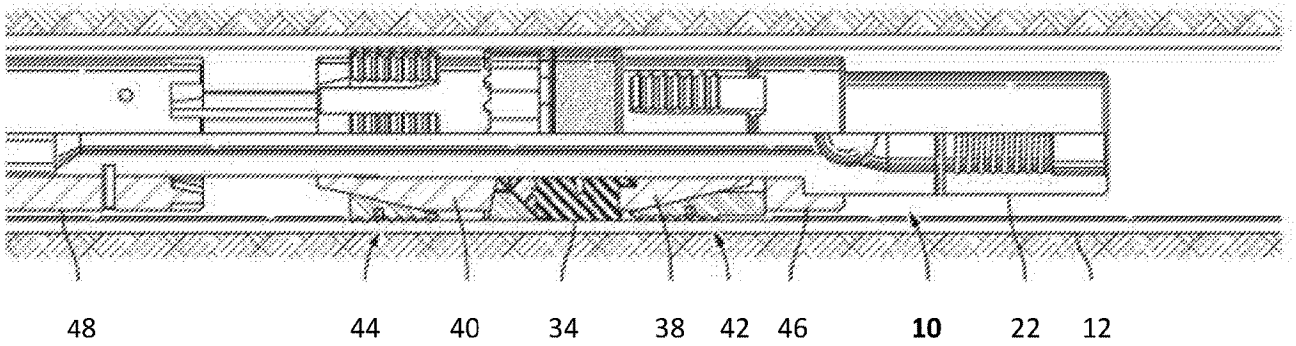

FIGS. 2-5 illustrate a drillable plug 10 is accordance with one or more embodiments. FIGS. 2 and 3 illustrate drillable plug 10 in an unset or unexpanded position for example in a run-in hole position prior to being set in the wellbore. In the run-in or unexpanded position an axial force has not been applied to the mandrel to move the slips and sealing element radially outward into engagement with the wellbore, e.g. casing 12. FIG. 4 illustrates plug 10 in an expanded or set position and FIG. 5 illustrates plug 10 in an expanded fracturing position.

Plug 10 includes a mandrel 22 having a bore 24 and a central longitudinal axis 26. Bore 24 is depicted as a continuous throughbore in FIG. 2. Mandrel 22 extends generally from a top end 28 to a bottom end 30 with reference to orientation of the tool when deployed in a well. Mandrel 22 may be formed of various materials of construction. In accordance to some embodiments, mandrel 22 may be constructed of a metallic material such as an aluminum material. In accordance to some embodiments, mandrel 22 is constructed of a non-metallic material, for example a composite material. Examples include carbon fiber reinforced material or other material that has high strength and that is drillable.

In accordance with one or more aspects, plug 10 may be utilized as a bridge plug or a frac plug. Plug 10 includes a closure member 32 positioned in or positionable in bore 24. Closure element 32 may permit one-way flow through the bore for example from the bottom to the top. For example, closure element 32 is depicted as a moveable element, such as a ball, in FIG. 2. In accordance to some embodiments, closure member 32 may separate bore 24 into two non-continuous sections for example as a bridge plug.

Plug 10 includes outer components that are mounted on the exterior of mandrel 22. Plug 10 includes a radially expandable seal element 34 disposed around the mandrel 22. When expanded the sealing element seals the annulus between the mandrel 22 and the inside wall of the wellbore as illustrated for example in FIGS. 1, 4, and 5. Seal element 34 may be constructed of various elastomeric materials, including without limitation a nitrile rubber, for example a hydrogenated nitrile butadiene rubber (HNBR), or fluoroelastomers. In accordance with one or more embodiments, seal element 34 is a component of an element assembly or package, generally denoted by the number 36. Upper and lower cones 38, 40 are disposed around mandrel 22 on opposing sides of seal element 34 and element assembly 36. Upper and lower slip assemblies 42, 44 are disposed around mandrel 22 and adjacent the upper and lower cones 38, 40, respectively. Plug 10 includes an upper gage ring 46 disposed around the upper end of axial section 54 of mandrel 22 adjacent the top end and upper slip assembly 42. A lower or bottom sub 48 is disposed about the bottom end 30 of mandrel 22 adjacent lower slip assembly 44. Bottom sub 48 is non-rotationally secured to mandrel 22. Bottom sub 48 is depicted secured to mandrel 22 by a screw 19 in FIG. 2.

Figure 6:
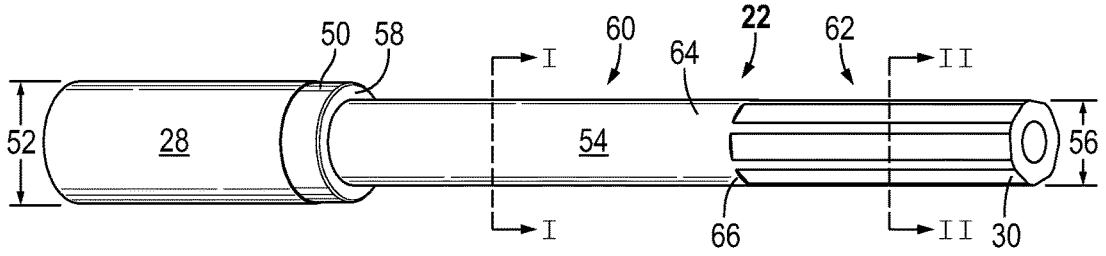
FIG. 6 illustrates a mandrel in accordance to one or more aspects of the disclosure.
Figure 7:
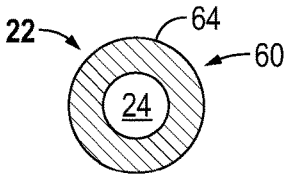
FIG. 7 is a sectional view of the mandrel along the line I-I of FIG. 6 illustrating a circular geometry portion in accordance to one or more aspects of the disclosure.
Figure 8:
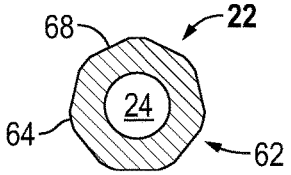
FIG. 8 is a sectional view of the mandrel along the line II-II of FIG. 6 illustrating a non-circular geometry portion in accordance to one or more aspects of the disclosure.

FIGS. 6-8 illustrate a mandrel 22 in accordance to one or more aspects of the disclosure. Mandrel 22 includes a top section 50 having a first outside diameter 52 and a lower axial section 54 having a second outside diameter 56. In accordance to embodiments, second outside diameter 56 is less than first outside diameter 52 and the outer components are disposed onto mandrel 22 from bottom end 30. An upper shoulder or stop 58 is formed by the change in diameter between top section 50 and the lower axial section 54. With reference to FIGS. 2 and 3, in the unexpanded position the upper gage ring 46 is located adjacent the top end of the mandrel for example adjacent upper stop 58.

Lower axial section 54 includes a circular cross-sectional portion 60 or circular mandrel profile 60 and a non-circular cross-sectional portion 62 or non-circular mandrel profile 62. With particular reference to FIGS. 7 and 8, the terms circular and non-circular refer to the geometric shape of the outer circumferential surface 64 of the respective mandrel section. A transition point or shoulder 66 separates the circular mandrel profile 60 from the non-circular mandrel profile 62. Circular mandrel profile 60 extends axially down from the upper stop 58, i.e. diameter transition, generally to the geometry transition shoulder 66. The lower non-circular mandrel profile 62 extends upward from the bottom end 30 generally to the geometry transition shoulder 66. The non-circular mandrel profile 62 may be formed in various manners and configurations. In FIGS. 6 and 8, non-circular mandrel profile 62 is illustrated shaped as a polygon having axially extending flattened portions 68. However, the non-circular mandrel profile 62 may be formed in various manners, such as and without limitation, an ellipse, a triangle, a spline, a square, or a rectangle. As further described below at least a portion of the inside circumferential surface of lower cone 40 is formed to correspond with non-circular mandrel profile section 62 thereby rotationally locking lower cone 40 and mandrel 22 together.

Figure 10:
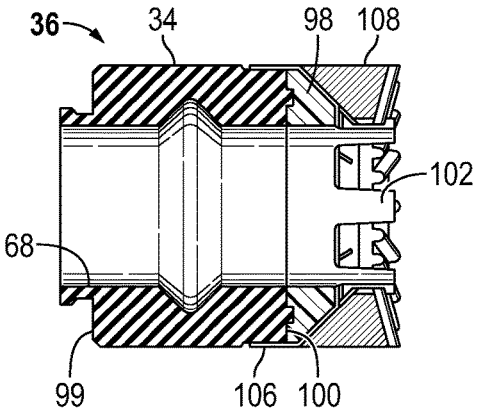

In accordance with aspects of some embodiments, seal element 34 is disposed around the circular mandrel profile 60 such that the inner surface 68 (FIG. 10) of seal element seals on the circular outer surface 64. Sealing on the smooth circular mandrel profile provides a more reliable seal than on a non-circular mandrel profile.

With additional reference to FIGS. 12-15, lower cone 40 is configured to be disposed about the non-circular mandrel profile 62. In accordance with one or more embodiments, lower cone 40 is disposed around mandrel 22 at the geometry transition 66. The cooperative connection of lower cone 40 and mandrel 22 prevents mandrel 22 from spinning when drilling or milling out the plug. In accordance to some embodiments, the cooperative connection of lower cone 40 and mandrel 22 may prevent mandrel 22 from falling through lower cone 40 and falling into the wellbore when drilling or milling plug 10. For example, the circular mandrel profile section 60 has an outer diameter and or geometric profile that will not pass through the non-circular portion of the lower cone passage.

Lower cone 40 extends from an upper or front face 70 oriented toward the seal assembly and a lower or back end 72 adjacent the lower slip assembly 44 and the lower sub. Lower cone 40 has an inner wall or surface 75 (FIG. 14) forming a passage 80 in which mandrel 22 is non-rotationally disposed, i.e. rotationally locked with the lower cone. Passage 80 includes a non-circular profile section 74 and a circular profile section 78 separated at a geometry transition point 76. For example, non-circular passage profile section 74 extends axially from back end 72 to inside transition point or shoulder 76 (e.g., geometry transition) of the cone passage and circular passage profile section 78 extends from the front face 70 to the inside geometry transition shoulder 76. The inner surface 75 of the non-circular profile section 74 is cooperative with mandrel surface 64 of the non-circular mandrel profile section 62 to prevent mandrel 22 from rotating relative to lower cone 40. Similarly, the surface of circular passage profile section 78 is cooperative to dispose the circular mandrel profile section 60. The transition shoulder 76 corresponds to the matching change in the geometric profile of outer surface 64 of mandrel 22 at transition shoulder 66, such that during a drilling or milling process, the mandrel 22 stays in an axial position within the lower cone and thereby prevents the mandrel from falling out of the outer plug assembly during the drilling or milling operations.

Figure 12:
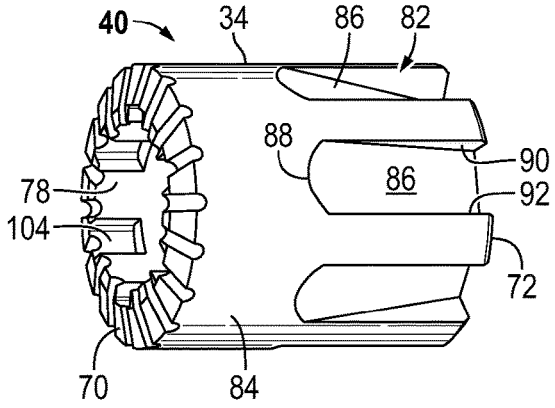
FIG. 12 illustrates a lower cone in accordance to one or more aspects of the disclosure.
Figure 13:
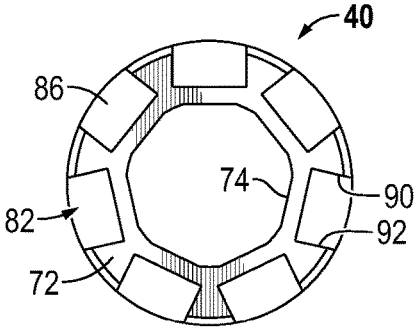
FIG. 13 is an end view of a bottom end of a lower cone in accordance to one or more aspects of the disclosure.
Figure 14:
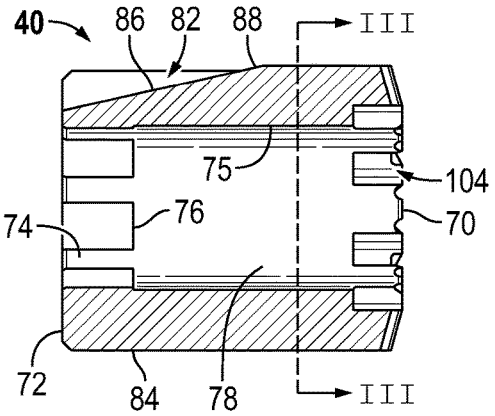
FIG. 14 is a sectional view of a lower cone in accordance to one or more aspects of the disclosure.
Figure 15:
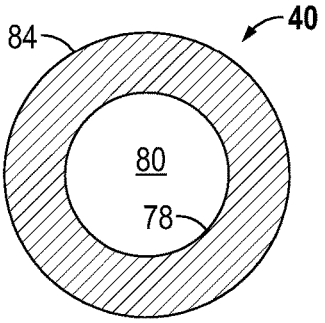
FIG. 15 is a cross-sectional view of a lower cone along the line III-III of FIG. 14 in accordance to one or more aspects of the disclosure.
Figure 16:
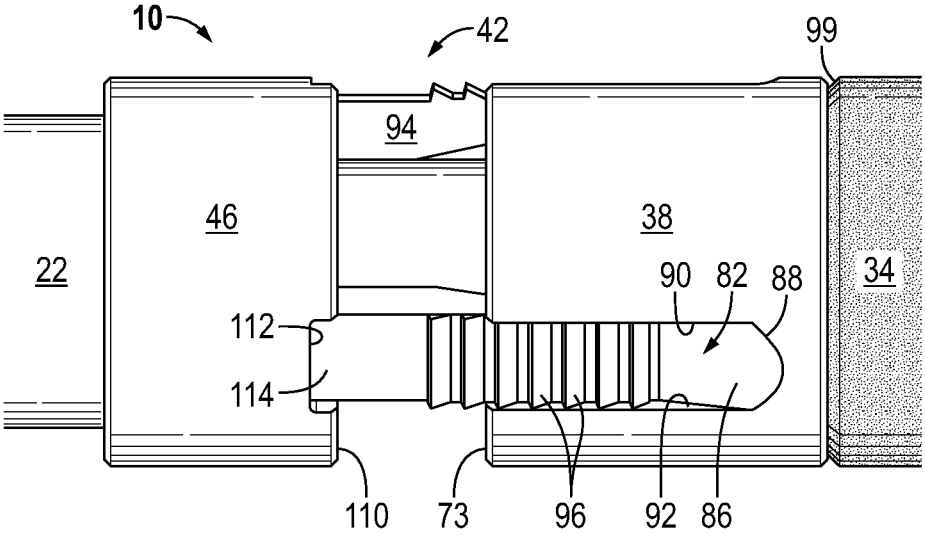
FIG. 16 illustrates an upper slip assembly, upper gage ring, and upper cone in accordance to one or more aspects of the disclosure.

In accordance to one or more embodiments upper cone 38 and lower cone 40 include circumferentially spaced apart and axially extending sloped grooves 82 formed along the outer surface 84 of the respective cones 38, 40. With reference in particular to FIG. 12, each groove 82 (e.g., channel) extends along a sloped bottom surface 86 from the lower or back end 72 of lower cone 40 to an end 88. The outer diameter of the lower cone 40 at each groove increases axially from the back end 72 to the end point 88. With reference in particular to FIG. 16 illustrating an upper cone 38, each groove 82 extends along a sloped bottom surface 86 from an upper end 73 of upper cone 38 to an end 88. The outer diameter of the upper cone 38 at each groove increases axially from the upper end 73 to the end point 88.

The grooves 82 are formed in the outer surface 84 of the cone such that the sloped bottom surface 86 of each groove is positioned between opposing side walls 90, 92. Each groove disposes a slip assembly such that a slip base 94 axially slides along the sloped bottom surface 86 of the groove 82 from an unset position to radially extend the slip grips 96 (e.g., teeth, serrations, threads, etc.) and grip the casing wall when the tool is in the set or expanded position, see e.g. FIGS. 4 and 5. During drilling or milling operations the slips are radially expanded to grip the casing 12 wall. The positioning of the slip assemblies in grooves 82 rotationally locks the cones with the slip assemblies and thereby prevents the cones from rotating during the milling or drilling process.

Figure 17:
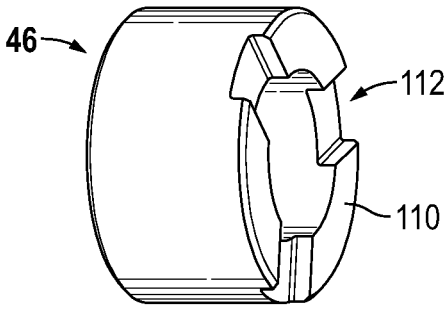
FIG. 17 illustrates an upper gage ring in accordance to one or more aspects of the disclosure.

With additional reference to FIGS. 16 and 17, each upper slip assembly 42 is depicted mating with a lower face 110 of upper gage ring 46. For example, lower face 110 forms pockets 112 in which an upper end 114 of upper slip assembly 42 is disposed. The positioning of the upper end 114 of the upper slip assembly in gage ring pocket 112 and the positioning of the slip base in the groove 82 of upper cone 38 rotationally locks the gage ring and upper cone together during milling or drilling operations.

Figure 9:
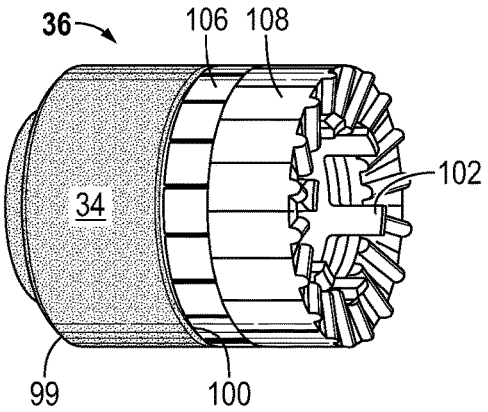
FIGS. 9 and 10 illustrate a seal element assembly in accordance to one or more aspects of the disclosure.
Figure 11:
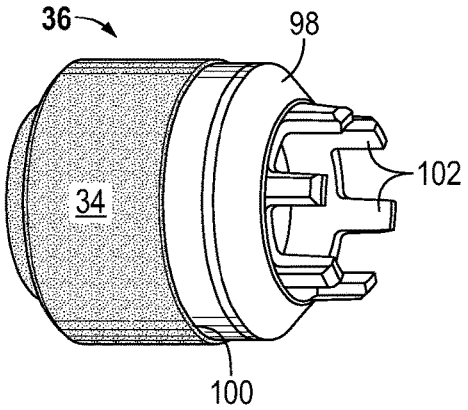
FIG. 11 illustrates a seal element and element end ring arrangement in accordance to one or more aspects of the disclosure.

With reference back to FIGS. 9-11, element assembly 36 may include one or more element end rings disposed around mandrel 22 and proximate to one end or both ends 99, 100 of seal element 34. FIG. 11 illustrates a seal element 34 in accordance to one or more aspects. Seal element 34 includes a lower element end ring 98 disposed circumferentially along the lower end 100 of seal element 34. Element end ring 98 may be formed for example of a phenolic plastic, for example a fiber impregnated phenolic plastic. For example, element end ring 98 may be bonded to the end of seal element 34 or element end ring 98 may be molded with seal element 34 such that sealing element 34 and element end ring 98 form a single component. In accordance to one or more embodiments, element end ring 98 includes axially outward extending members 102 (e.g., splines, tabs) that are configured to mate with corresponding recesses or pockets 104 formed in the inside wall or surface 75 of lower cone 40 adjacent to the upper or front face 70 of the lower cone. For example, pockets 104 may be formed in inner surface 75 of circular passage profile section 78 of the lower cone 40. The axial extensions 102 may be positioned on the surface of the lower axial section of the mandrel 22 to slide into the pockets 104 which are open at front face 70 and open along the inner surface 75 of the lower cone. When element assembly 36 is compressed between upper cone 38 and lower cone 40, axial extending members 102 are disposed in pockets 104 thereby rotationally locking seal element 34 with lower cone 40. In accordance to some embodiments, the axial extending members 102 transfer torque from seal element 34 to lower cone 40 during drilling or milling operations thereby resisting or preventing rotation of the seal element during drilling or milling operations. Element end ring 98 may also provide extrusion support to seal element 34.

Drillable plug 10 may be utilized in high pressure and high temperature environments which have negative effects on the seal element. In particular, the seal element may weaken or degrade and extrude through any gaps that may exist in the support structure around the seal element. Element assembly 36 may include one or more extrusion barrier elements. For example, with reference in particular to FIGS. 9 and 10, element assembly 36 includes one or more barrier rings 106 and a back-up ring 108. For example, barrier rings 106 may be a cap like member for example formed of an aluminum alloy or composite material and having slits dividing the barrier ring into segments. The back-up ring 108 in accordance to embodiments may be formed of a different material than barrier ring 106. For example, barrier ring 106 may be constructed of a metallic material and back-up ring 108 may be formed of a composite material such as a phenolic plastic. The slits dividing back-up ring 108 are circumferentially offset from the slits in the barrier ring 106.

The foregoing outlines features of several embodiments of drillable plugs so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A drillable plug, comprising:

a mandrel having a top end and a lower axial section, wherein the lower axial section comprises a geometry transition point having a transition shoulder separating an upper outer surface having a circular mandrel profile from a lower outer surface having a non-circular mandrel profile, the lower outer surface extending the length of the lower axial section from the geometry transition point to a bottom end of the mandrel;

a seal element disposed around the upper outer surface;

a lower cone having an inner surface forming a passage, the lower cone disposed around the lower outer surface of the mandrel, wherein the inner surface is configured to mate with the lower outer surface of the mandrel, whereby the lower cone is rotationally locked with the mandrel; and a lower slip assembly moveably disposed on a sloped outer surface of the lower cone, wherein the transition shoulder is shaped so as to prevent the upper outer surface from moving completely into the passage of the lower cone, and wherein axial motion of the mandrel within the drillable plug pushes the lower cone axially along the mandrel to force the lower slip assembly radially outward to engage an inside wall of a casing within which the drillable plug is deployed.

2. The drillable plug of claim 1, wherein the passage comprises a circular section and a non-circular section.

3. The drillable plug of claim 1, wherein the passage comprises a circular section disposed about the upper outer surface having the circular mandrel profile and a non-circular section disposed around the lower outer surface having the non-circular mandrel profile.

4. The drillable plug of claim 1, wherein the seal element comprises an end ring connected to a lower end of the seal element and comprising an axially extending member connectable with the lower cone.

5. The drillable plug of claim 1, wherein the lower cone comprises a recess formed along the inner surface; and the seal element comprises an end ring connected to a lower end of the seal element and comprising an axially extending member disposed in the recess.

6. The drillable plug of claim 1, wherein the sloped outer surface is positioned in a groove between opposing side walls.

7. The drillable plug of claim 1, further comprising:

an upper gage ring disposed around the mandrel adjacent the top end;

an upper cone disposed around the upper outer surface between the upper gage ring and the seal element; and an upper slip assembly moveably disposed on a sloped outer surface of the upper cone, wherein the sloped outer surface is positioned in a groove between opposing side walls; and wherein the axial motion of the mandrel within the drillable plug pushes the upper cone axially along the mandrel to force the upper slip assembly radially outward to engage the inside wall of the casing.

8. The drillable plug of claim 1, further comprising:

an upper gage ring disposed around the mandrel adjacent the top end;

an upper cone disposed around the upper outer surface between a lower face of the upper gage ring and the seal element; and an upper slip assembly comprising an upper end and a slip base, the upper end rotationally locked with the upper gage ring and the slip base moveably disposed on a sloped outer surface of the upper cone; and wherein the axial motion of the mandrel within the drillable plug pushes the upper cone axially along the mandrel to force the upper slip assembly radially outward to engage the inside wall of the casing.

9. The drillable plug of claim 1, further comprising:

an upper gage ring disposed around the mandrel adjacent the top end and having a lower face forming a pocket;

an upper cone disposed around the upper outer surface between the lower face and the seal element; and an upper slip assembly comprising an upper end and a slip base, the upper end positioned in the pocket and the slip base moveably disposed on a sloped outer surface, wherein the sloped outer surface is located between opposing side walls; and wherein the axial motion of the mandrel within the drillable plug pushes the upper cone axially along the mandrel to force the upper slip assembly radially outward to engage the inside wall of the casing.

10. A method, comprising:

milling or drilling through a drillable plug that is set in a wellbore, the drillable plug comprising:

a mandrel having a top end and a lower axial section, wherein the lower axial section comprises a geometry transition point having a transition shoulder separating an upper outer surface having a circular mandrel profile from a lower outer surface having a non-circular mandrel profile, the lower outer surface extending the length of the lower axial section from the geometry transition point to a bottom end of the mandrel;

an upper gage ring disposed around the mandrel adjacent the top end; a seal element disposed around the upper outer surface;

an upper cone disposed around the upper outer surface between the upper gage ring and the seal element;

an upper slip assembly moveably disposed on a sloped outer surface of the upper cone;

a lower cone having an inner surface forming a passage, the lower cone disposed around the lower outer surface of the mandrel, wherein the inner surface is configured to mate with the lower outer surface of the mandrel, whereby the lower cone is rotationally locked with the mandrel; and a lower slip assembly moveably disposed on a sloped outer surface of the lower cone, wherein the transition shoulder is shaped so as to prevent the upper outer surface from moving completely into the passage of the lower cone, and wherein axial motion of the mandrel within the drillable plug pushes the upper and lower cones axially along the mandrel to force the upper and lower slip assemblies radially outward to engage an inside wall of a casing within which the drillable plug is deployed.

11. The method of claim 10, wherein the passage comprises a circular section and a non-circular section.

12. The method of claim 10, wherein the passage comprises a circular section disposed about the upper outer surface having the circular mandrel profile and a non-circular section disposed around the lower outer surface having the non-circular mandrel profile.

13. The method of claim 10, wherein the seal element comprises an end ring connected to a lower end of the seal element and comprising an axially extending member connectable with the lower cone.

14. The method of claim 10, wherein the lower cone comprises a recess formed along the inner surface; and the seal element comprises an end ring connected to a lower end of the seal element and comprising an axially extending member disposed in the recess.

15. The method of claim 10, wherein the sloped outer surface of the upper cone is positioned in a groove between opposing side walls and the sloped outer surface of the lower cone is positioned in a groove between opposing side walls.

16. The method of claim 10, wherein the upper slip assembly comprises an upper end and a slip base, the upper end rotationally locked with the upper gage ring and the slip base is moveably disposed on the sloped outer surface of the upper cone.

17. The method of claim 16, wherein the sloped outer surface of the upper cone is disposed in a groove disposed between opposing side walls.

18. The method of claim 10, wherein the upper gage ring comprises a lower face forming a pocket; and the upper slip assembly comprises an upper end and a slip base, the upper end positioned in the pocket and the slip base moveably disposed on the sloped outer surface of the upper cone, wherein the sloped outer surface of the upper cone is located between opposing side walls.

19. A drillable plug, comprising:

a mandrel having a top end and a lower axial section, wherein the lower axial section comprises a geometry transition point having a transition shoulder separating an upper outer surface having a circular mandrel profile from a lower outer surface having a non-circular mandrel profile, the lower outer surface extending the length of the lower axial section from the geometry transition point to a bottom end of the mandrel;

an upper gage ring disposed around the mandrel adjacent the top end; a seal element disposed around the upper outer surface;

an upper cone disposed around the upper outer surface between the upper gage ring and the seal element;

an upper slip assembly moveably disposed on a sloped outer surface of the upper cone that is disposed between opposing side walls;

a lower cone having an inner surface forming a passage comprising a circular section disposed about the upper outer surface and a non-circular section disposed around the lower outer surface whereby the lower cone is rotationally locked with the mandrel;

a lower slip assembly moveably disposed on a sloped outer surface of the lower cone that is disposed between opposing side walls; and an end ring connected to a lower end of the seal element and comprising an axially extending member disposed in a recess formed in the inner surface of the lower cone, wherein the transition shoulder is shaped so as to prevent the upper outer surface from moving completely into the passage of the lower cone, and wherein axial motion of the mandrel within the drillable plug pushes the upper and lower cones axially along the mandrel to force the upper and lower slip assemblies radially outward to engage an inside wall of a casing within which the drillable plug is deployed.

20. The drillable plug of claim 19, wherein the upper gage ring comprises a lower face forming a pocket; and the upper slip assembly comprises an upper end and a slip base, the upper end positioned in the pocket and the slip base moveably disposed on the sloped outer surface of the upper cone.

* * * * *